US009429034B2

(12) United States Patent
Leblanc

(10) Patent No.: US 9,429,034 B2
(45) Date of Patent: Aug. 30, 2016

(54) METHOD OF FABRICATING A TURBINE ENGINE SHAFT

(71) Applicant: SNECMA, Paris (FR)

(72) Inventor: Jonathan Leblanc, Vitry sur Seine (FR)

(73) Assignee: SNECMA, Paris (FR)

( * ) Notice: Subject to any disclaimer, the term of this patent is extended or adjusted under 35 U.S.C. 154(b) by 89 days.

(21) Appl. No.: 14/367,076

(22) PCT Filed: Dec. 7, 2012

(86) PCT No.: PCT/FR2012/052848
§ 371 (c)(1),
(2) Date: Jun. 19, 2014

(87) PCT Pub. No.: WO2013/093285
PCT Pub. Date: Jun. 27, 2013

(65) Prior Publication Data

US 2014/0352146 A1 Dec. 4, 2014

(30) Foreign Application Priority Data

Dec. 23, 2011 (FR) ..... 11 62438

(51) Int. Cl.
*F01D 25/00* (2006.01)
*B21K 1/06* (2006.01)
*B21K 3/00* (2006.01)

(52) U.S. Cl.
CPC ..... *F01D 25/00* (2013.01); *B21K 1/063* (2013.01); *B21K 3/00* (2013.01); *F05D 2230/25* (2013.01); *Y10T 29/49229* (2015.01)

(58) Field of Classification Search
CPC ..... Y10T 29/4932; Y10T 29/49885; Y10T 29/49229; B21D 53/84; B21D 53/00; F01D 25/00; B21K 1/063; B21K 3/00; B21K 1/06; B21K 1/10; B21K 21/16; B21K 21/12; F05D 2230/25; B23P 11/02; B23P 11/11; B23P 11/025
USPC ..... 415/216.1; 72/356
See application file for complete search history.

(56) References Cited

U.S. PATENT DOCUMENTS 2,487,304 A * 11/1949 Brauchler ..... B21J 1/06 148/534
2,748,466 A * 6/1956 Brown ..... B21K 1/06 72/341

(Continued)

FOREIGN PATENT DOCUMENTS

FR 2 929 149 10/2009
GB 371 993 5/1932
GB 371993 A * 5/1932 ..... B21C 37/08

OTHER PUBLICATIONS

International Search Report Issued Apr. 22, 2013 in PCT/FR12/052848 Filed Dec. 7, 212.

*Primary Examiner* — David Bryant
*Assistant Examiner* — Lawrence Averick
(74) *Attorney, Agent, or Firm* — Oblon, McClelland, Maier & Neustadt, L.L.P.

(57) ABSTRACT

A method of fabricating a turbine engine shaft from a metal billet of generally cylindrical shape, the method including drilling the billet to form a through axial cylindrical bore therein, engaging a cylindrical insert in the bore, the insert being made of a material having yield stress close to that of the material of the billet so that the materials of the insert and of the billet have substantially the same behavior during forging, hot forging the billet to form a forged blank of length greater than that of the billet, withdrawing the insert, and machining the blank.

6 Claims, 2 Drawing Sheets

(56) References Cited

U.S. PATENT DOCUMENTS

| | | | | |
|---|---|---|---|---|
| 3,465,418 | A * | 9/1969 | Clark | B21K 1/063 228/152 |
| 3,668,918 | A * | 6/1972 | Benteler | B21K 1/10 138/109 |
| 9,010,167 | B2 * | 4/2015 | Green | B21D 22/00 72/342.7 |
| 9,138,838 | B2 * | 9/2015 | Calla | B23P 15/006 |
| 2010/0143527 | A1 * | 6/2010 | Mathai | B21C 23/183 425/381 |
| 2011/0027097 | A1 | 2/2011 | Bertrand et al. | |
| 2011/0078896 | A1 * | 4/2011 | Calla | B23P 15/006 29/598 |
| 2011/0091324 | A1 * | 4/2011 | Holzschuh | B23P 15/006 416/200 A |

* cited by examiner

METHOD OF FABRICATING A TURBINE ENGINE SHAFT

The invention relates to a method of fabricating a turbine engine shaft, such as a low-pressure turbine shaft of a turbine engine.

A low pressure (LP) turbine shaft is made as a single piece that comprises a substantially cylindrical elongate portion that is connected at one end to a trunnion of greater outside diameter, the shaft being hollow and including an axial cylindrical bore that extends over the entire axial length of the shaft.

Typically, an LP shaft has a length longer than 1.2 meters (m), its elongate cylindrical portion having an outside diameter of less than about 20 centimeters (cm) and an inside diameter greater than about 2 cm.

In the prior art, a shaft of this type is made from a metal billet of generally cylindrical shape by a method that essentially comprises three steps: a step of hot forging the billet to form a blank having an axial dimension greater than that of the billet; a step of boring or drilling the blank in order to form an axial cylindrical bore in the blank; and then a step of machining the blank.

New generation turbine engines have turbine shafts of ever-increasing length together with inside diameters of ever-decreasing size. Furthermore, turbine shafts are being made of ever-stronger materials that are more and more difficult to machine. The above-mentioned geometrical constraints (shafts becoming longer and inside diameter becoming smaller) combined with the difficulties of machining the materials from which the shafts are made are causing turbine shafts to become ever more difficult to fabricate, in particular in the above-mentioned boring or drilling step.

New technologies have already been proposed for boring a forged blank along a great length. A new machining tool has been developed comprising a longitudinal arm carrying a machining tool at one end. Nevertheless, that solution is not entirely satisfactory since there are considerable risks of the arm coming out of alignment relative to the longitudinal axis of the blank and of the boring being deviated.

An object of the invention is to provide a solution to this problem of the prior art that is simple, effective, and inexpensive.

To this end, the invention proposes a method of fabricating a turbine engine shaft from a metal billet of generally cylindrical shape, the method comprising a step of hot forging the billet in order to form a forged blank of greater length than the billet, and a step of machining the blank, the method being characterized in that it comprises:

prior to the forging step, a step of boring or drilling the billet in order to form an at least partially through axial cylindrical bore therein, and a step of engaging an insert in the bore, the insert being of a substantially cylindrical shape complementary to the shape of the bore and being made of a material having yield stress during forging that is close to the yield stress of the material of the billet such that the materials of the insert and of the billet have substantially the same behavior during forging; and after the forging step, a step of withdrawing the insert.

The method of the invention differs from the prior art in particular in that the boring or drilling takes place before forging and not after, such that it is the billet that is drilled and not the forged blank. The billet is shorter than the blank. It is therefore easier to drill the billet than it is to drill the blank, since drilling takes place over a shorter distance and can be performed using means that are conventional and reliable.

The method of the invention also differs from the prior art in that an insert is engaged in the bore in the billet, before it is forged. This insert, which is of a shape complementary to the shape of the bore in the billet, is to become deformed together with the billet during the forging, and it serves to force the inside surface of the billet to conserve a shape that is substantially cylindrical during forging, such that after forging the bore presents a shape and dimensions that could be obtained directly by drilling the blank, if such drilling were easy to perform. The method of the invention thus proposes an alternative to drilling the forged blank to a given diameter d1, by drilling the billet to a diameter d2, by inserting an insert of diameter d2 in the billet, and by forging the billet in such a manner that the diameter of its bore becomes smaller during forging and goes from the diameter d2 to the diameter d1.

In order to make this phenomenon possible, it is necessary for the materials of the insert and of the billet to have behaviors that are similar during forging, and in particular for them to have yield stresses that are similar, e.g. of the order of 50 megapascals (MPa) to 250 MPa at 1000° C., i.e. they need to have rheologies that are similar at the forging temperature.

In a particular implementation of the invention, the insert is made of NC19FeNb and the billet is made of X25NiCoCr1313-6-4 or X1NiCoMo18-8-5 steel.

In a first embodiment of the invention, the insert is removably engaged in the bore of the billet and its material has a coefficient of thermal expansion that is different from that of the blank such that the insert can be withdrawn from the blank by heating or cooling the blank and the insert and then by moving the insert in axial translation relative to the blank. The cooling subsequent to the forging of the part gives rise to shrinkage of the insert and of the blank, and given the differences in the expansion coefficients of their materials, this may suffice to allow the insert to be withdrawn from the bore in the blank.

In a variant, the material of the insert presents hardness that is less than that of the material of the forged billet, and the insert may be withdrawn by machining, e.g. during the above-mentioned step of machining the blank.

In yet another variant, the insert is withdrawn by chemically etching its material.

Advantageously, the outer cylindrical surface of the insert is coated in a thin layer of a barrier substance and/or an anti-adhesive substance, such as a lubricant, which substance withstands the temperatures at which the billet is forged. A barrier substance serves to prevent any contamination of one material by another material at the interface between the materials, and an anti-adhesive substance serves to limit or prevent one of the materials adhering to the other material at their interface.

The insert may be engaged in the bore of the billet at ambient temperature.

The insert may be axially retained in the bore of the billet at one or both of its axial ends, e.g. by spot welds between the billet and the insert.

The present invention also provides a forged blank or a billet for fabricating a turbine engine shaft, comprising a metal body of elongate cylindrical shape, characterized in that it has a through axial cylindrical bore having received therein an insert of shape complementary to the shape of the bore and made of a material that firstly presents yield stress close to that of the material of the billet, and secondly presents a coefficient of thermal expansion that is different from that of the material of the blank or of the billet, or hardness that is less than that of the material of the blank or of the billet.

The invention can be better understood and other details, advantages and characteristics of the invention appear on reading the following description made by way of nonlimiting example and with reference to the accompanying drawings, in which.

Figure 1:
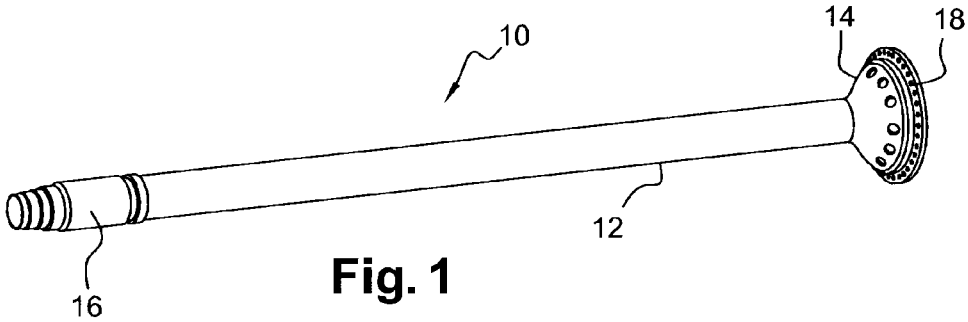
FIG. 1 is a diagrammatic perspective view of a low-pressure turbine shaft of a turbine engine.

FIG. 1 shows a low-pressure turbine shaft 10 of a turbine engine such as an airplane turboprop or turbojet, the shaft being made as a single piece of a metal alloy such as steel (e.g. X25NiCoCr1313-6-4). The shaft 10 is hollow and has an axial cylindrical bore that extends over the entire axial length of the shaft.

The shaft 10 has an elongate cylindrical portion 12 connected at one axial end to a trunnion 14 of larger outside diameter and smaller axial dimension than the portion 12. Typically, the shaft 10 has a length greater than 1.2 m or even 2 m, its cylindrical portion 12 having an inside diameter greater than 20 millimeters (mm) and an outside diameter less than 200 mm, and its trunnion 14 having an outside diameter greater than 200 mm. In known manner, the trunnion 14 of the shaft 10 includes an outer annular flange 18 for fastening to an element of the rotor of the turbine, and in the vicinity of its end remote from the trunnion 14, the cylindrical portion 12 of the shaft 10 includes external fluting 16 for driving an element of the rotor of the turbine engine.

In the prior art, a turbine shaft 10 of this type is made by a fabrication method comprising three steps that are shown diagrammatically in FIGS. 2 to 5.

Figure 2:
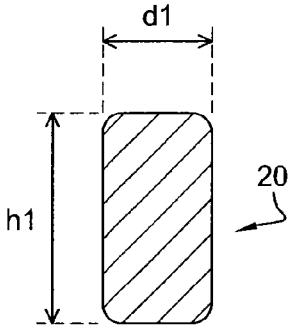
FIG. 2 is a diagrammatic axial section view of a metal billet for forming a turbine engine shaft.

The shaft 10 is made from a metal billet 20 shown in FIG. 2, the billet having a generally cylindrical shape of diameter d1 and of height or length h1. This billet 20 is to be subjected to hot forging in order to form a forged blank 22 of the type shown in FIG. 3.

The blank 22 comprises a cylinder 24 of height h2 and of outside diameter d2, which is connected at one axial end to a trunnion 26 of height h3 and of outside diameter d3, where h3 is less that h2, and d3 is greater than d3, with h2+h3 being greater than h1. It can be understood that the above-mentioned cylindrical portion 12 of the shaft 10 of FIG. 1 is to be formed out of the cylinder 24 of the blank 22, and that its trunnion 14 is to be formed in the trunnion 26 of the blank.

Figure 4:
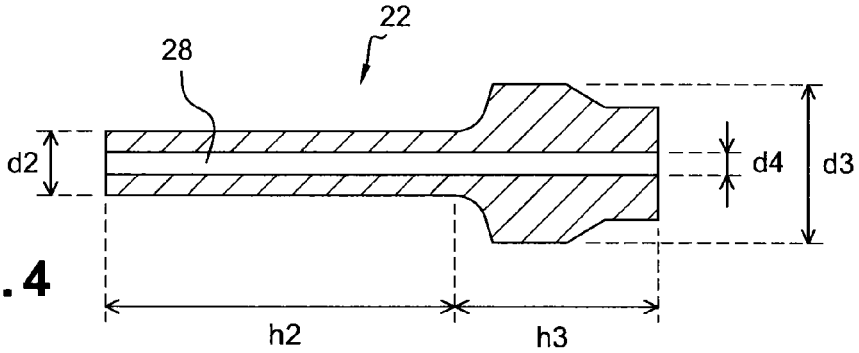
FIG. 4 is a diagrammatic axial section view of a forged and drilled blank for forming a turbine engine shaft.

The blank 22 is then subjected to a boring or drilling step consisting in forming an axial cylindrical bore in the blank, with a forged and drilled blank being shown diagrammatically in FIG. 4.

The drilling 28 passes through the blank 22 axially and is thus performed over the entire length or axial dimension of the blank. The drilling 28 thus takes place over a distance h2+h3 that may exceed 1.2 m. The drilling 28 is performed with a diameter d4.

In the prior art, this bore is difficult and complex to drill. The drilling means required are expensive and increase the risk of the drilling being poor because of misalignment between the drilling means and the longitudinal axis of the blank, and thus of the blank being discarded.

Figure 5:
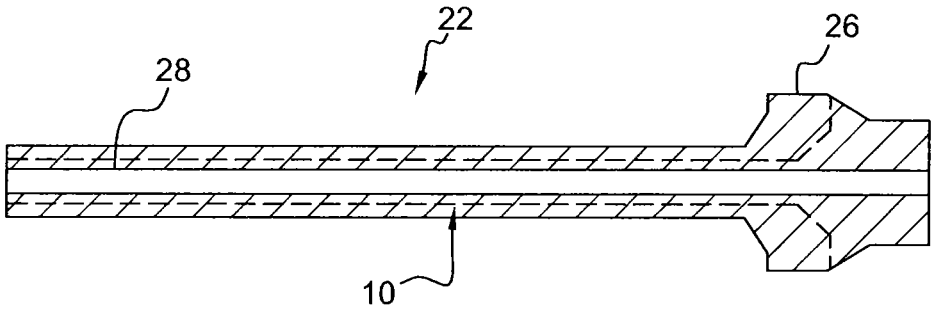
FIG. 5 is a diagrammatic axial section view of a forged and drilled blank, the figure showing a turbine engine shaft that is to be obtained after machining the blank.

A last fabrication step consists in machining the forged and drilled blank 22 in order to form the shaft 10 (FIG. 5).

The present invention proposes a novel method of fabricating a turbine shaft of a turbine engine in which the drilling step is made considerably easier.

The prior art step of drilling the forged blank is replaced to buy a step of drilling the billet. Since the billet has a length or axial dimension that is shorter than that of the blank, drilling takes place over a shorter distance and can be performed with conventional means that are simpler and less expensive. In the above-mentioned example, drilling would be performed over a distance h1 (determined so as to be no greater than h2+h3 after forging) instead of a distance h2+h3 (which is longer than h1, and of the order of 1.2 m, approximately).

By way of example, the means for drilling the billet comprise conventional tools and machines for machining (drill, lathe, etc).

The billet is drilled to a diameter d5 that is greater than the diameter d4 of the bore drilled in the blank in the prior art (FIG. 4), for reasons that are explained below.

Figure 6:
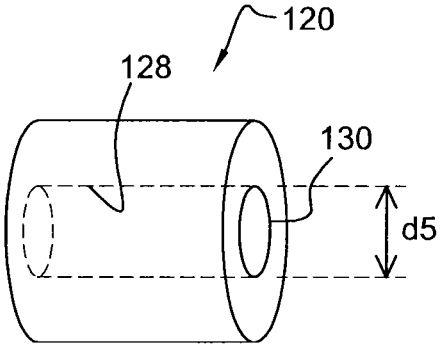
FIG. 6 is a diagrammatic perspective view of a drilled billet having an insert engaged in its bore, shown during a step of performing the method of the invention.

FIG. 6 shows a billet 120 of the invention, this billet having a generally cylindrical shape similar to that of the prior art, and having an outside diameter d1 and a height h1. This billet 120 is made of a metal alloy such as a steel (e.g. a X25NiCoCr1313-6-4 steel).

The billet 120 has an axial cylindrical bore 128 of diameter d5 that is obtained by drilling or boring, as explained above.

Before the step of forging the billet 120, an insert 130 is engaged in the bore 128 of the billet for the purpose of remaining in the bore during the forging step, after which it is removed from the bore.

This insert 130 is of a cylindrical shape that is complementary to the shape of the bore 128 in the billet 120 and it is engaged in the bore by moving in axial translation, e.g. at ambient temperature. The insert is to occupy all of the inside volume defined by the bore 128 in the billet. The outside spherical surface of the insert 130 is advantageously covered in a barrier substance and/or an anti-adhesive substance, such as a lubricant (e.g. the lubricant sold by the supplier Acheson under the trademark FB651).

The insert 130 is to be deformed during the forging step, together with the billet 120. The material of the insert 130 presents yield stress close to that of the material of the billet so that these materials behave similarly during forging, i.e. they deform in the same manner, as if the insert and the billet were constituted by a single piece.

The insert 130 is to retain its generally cylindrical shape during forging so as to force the bore 128 of the billet to conserve its cylindrical shape, and so as to make it easier to withdraw the insert after forging.

Figure 7:
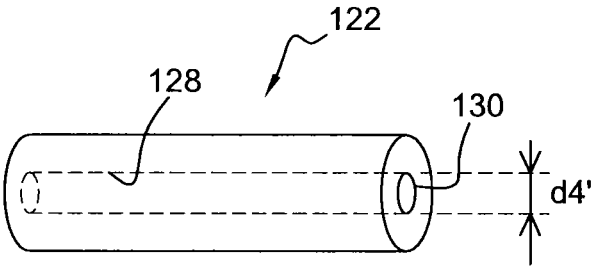
FIG. 7 is a diagrammatic perspective view of a forged blank made from the billet of FIG. 6.

Forging the billet makes it possible to form a forged blank 122 as shown diagrammatically in FIG. 7, this blank 122 having a bore 128 in which the insert 130 is still engaged, the bore having a diameter d4' that is less than the diameter d5 and substantially equal to the diameter d4 of the bore obtained by drilling in the prior art (FIG. 4). The billet is thus drilled to a diameter that is greater than the inside diameter of the forged blank since the forging reduces the diameter of the bore as a result of lengthening it.

Figure 3:
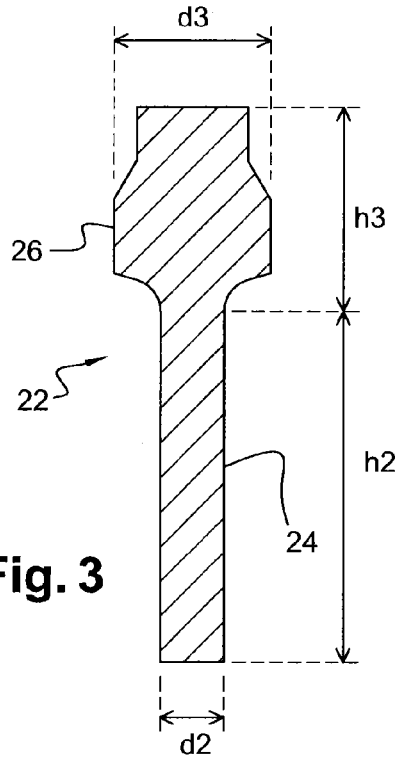
FIG. 3 is a diagrammatic axial section view of a forged blank for forming a turbine engine shaft.

The forged blank 122 shown diagrammatically in FIG. 7 may comprise two portions as shown in FIG. 3: a portion referred to as a "cylinder" of diameter d2 and of height h2, and a portion referred to as a "trunnion" of height h3 (less than h2) and of diameter d3 (greater than d2).

By way of example, the billet 120 is forged at a pressure lying in the range 500 metric tonnes (t) to 4000 t approximately, and at a temperature of approximately 1000° C., by means of a conventional forging system.

In order to avoid any axial movement of the insert 130 relative to the billet 120 during forging, it is possible to provide means for retaining the insert axially in the bore of the billet. By way of example, it is possible to retain the insert in the bore by means of spot welds made at one or both axial ends of the insert between the outer periphery of said end and the corresponding inner periphery of the billet.

Thereafter, the insert 130 is to be withdrawn from the bore 128 of the blank 122. The insert may be withdrawn in three different ways depending on the properties and the characteristics of the material of the insert 130.

When the material of the insert 130 has a coefficient of thermal expansion that is different from that of the billet 120, the insert may be withdrawn from the billet merely by being moved in axial translation after prior heating or cooling of the billet and the insert. By way of example, the billet and the insert may be heated to a temperature lying in the range 200° C. to 800° C., with the billet being made of a material with a coefficient of thermal expansion that is greater than that of the insert so that it expands more than insert, in particular in a radial direction, thereby enabling the insert to be withdrawn. This withdrawal may be forced by a tool appropriate for exerting a force on the insert along the longitudinal axis of the billet.

When the material of the insert 130 presents hardness that is less than that of the material of the billet 120, it is possible to envisage withdrawing the insert by machining. Even though the drilling is performed over a long axial distance, it can be done using conventional means since the material to be machined is not as hard as the material of the billet.

In a variant, when it is possible to degrade the material of the insert 130 by chemical means, the insert may be withdrawn by chemical etching. This operation may require the blank to be protected. By way of example, it is possible to use a chemical such as hydrochloric acid.

The invention claimed is:

1. A method of fabricating a turbine engine shaft from a metal billet of a generally cylindrical shape, the method comprising:

hot forging the billet to form a blank of a greater length than a length of the billet;

machining the blank; and prior to the forging, one of a boring and drilling comprising respectively boring and drilling the billet to form an at least partially through axial cylindrical bore in the billet, and removably engaging an insert in the bore, the insert being of a substantially cylindrical shape complementary to a shape of the bore and being made of a material having yield stress during forging that is close to yield stress of a material of the billet such that the materials of the insert and of the billet have substantially a same behavior during forging; and after the forging, withdrawing the insert, the material of the insert having a coefficient of thermal expansion that is lower than that of the blank, such that the insert is withdrawn from the blank by one of a heating and a cooling comprising respectively heating and cooling the blank and the insert, and then by moving the insert in an axial translation relate to the blank.

2. A method according to claim 1, wherein an outer cylindrical surface of the insert is coated in a thin layer of at least one of a barrier substance and an anti-adhesive substance, which substance withstands temperatures at which the billet is forged.

3. A method according to claim 1, wherein the insert is engaged in the bore of the billet at ambient temperature.

4. A method according to claim 1, wherein the insert is axially retained in the bore of the billet at at least one of axial ends.

5. A method according to claim 1, wherein the insert is made of NC19FeNb and the billet is made of one of X25NiCoCr1313-6-4 steel and X1NiCoMo18-8-5 steel.

6. A method according to claim 1, wherein the step of removably engaging the insert in the bore comprises engaging the insert having a first diameter in the bore having a second diameter which is the same as the first diameter.

* * * * *